United States Patent [19]

Rannigan et al.

[11] Patent Number: 4,709,717

[45] Date of Patent: Dec. 1, 1987

[54] CLEANING APPARATUS FOR PAINT ROLLERS AND THE LIKE

[76] Inventors: Robert C. Rannigan, 5825 Lexington La., Earlysville, Va. 22936; Gregory E. Webber, 13 Iroquois Trail, Ruckersville, Va. 22968

[21] Appl. No.: 861,402

[22] Filed: May 9, 1986

[51] Int. Cl.[4] ..... B08B 3/02

[52] U.S. Cl. ..... 134/199; 239/567

[58] Field of Search ..... 68/213; 239/DIG. 1, 239/567, 568; 134/199, 122 R, 144, 151, 153, 172, 138, 149

[56] References Cited

U.S. PATENT DOCUMENTS

| | | | |
|---|---|---|---|
| 1,829,831 | 11/1931 | Hiskey | 134/199 X |
| 2,776,230 | 1/1957 | Scott | 134/122 R X |
| 2,985,178 | 5/1961 | Christensen | 134/149 |
| 3,117,584 | 1/1964 | Elenbaas | 239/567 X |
| 3,334,639 | 8/1967 | Grant | 134/122 R |
| 3,441,355 | 4/1969 | Brown | 134/149 X |
| 4,517,699 | 5/1985 | Petricka | 15/104.92 X |
| 4,606,777 | 8/1986 | Brow | 15/104.92 X |

FOREIGN PATENT DOCUMENTS

| | | | |
|---|---|---|---|
| 307176 | 4/1933 | Italy | 239/567 |

*Primary Examiner*—Philip R. Coe

*Attorney, Agent, or Firm*—Quaintance, Murphy & Presta

[57] ABSTRACT

According to the present invention there is provided a cleaning apparatus for cleaning a paint roller and the like. The cleaning apparatus comprises a handle having an axial passage therethrough and a curved cleaning head, adjacent one end of the handle, having an annular passage in fluid communication with the axial passage of the handle. A plurality of spaced, radially inwardly extending nipples are positioned circumferentially along the inner surface of the curved cleaning head. Each of the nipples has an end face provided with a fluid outlet and a fluid passage extending from the fluid outlet to the annular passage of the curved cleaning head. Means for attaching the cleaning apparatus to a cleaning fluid supply are provided at the other end of the handle.

9 Claims, 5 Drawing Figures

CLEANING APPARATUS FOR PAINT ROLLERS AND THE LIKE

BACKGROUND OF THE INVENTION

The present invention relates to a cleaning apparatus for cleaning roller-type paint applicators and the like.

The use of roller-type applicators for applying paint is very popular because of the desirable coating characteristics achieved by such paint rollers. However, these paint rollers are difficult to clean and the need for a device to effectively remove paint from these rollers is evidenced by the large number of patents directed to removing paint from rollers. Effective cleaning of a paint roller depends upon the dilution and removal of paint which has been absorbed into the fabric of the paint roller.

It is well known that a paint roller may be hand-washed in a large excess of cleaning fluid. Generally, the cleaning fluid can be water if the paint to be removed is a water based paint or it can be another solvent if the paint has a solvent base other than water. While hand-washing of a paint roller may remove surface paint on the roller, such washing does not efficiently remove paint or other deposits deep down in the fabric of the roller. In fact, conventional means of flushing water over the fabric cover externally causes paint to be flushed deep into the cover, thereby never really cleaning the cover throughout.

Prior devices for cleaning paint rollers have generally provided means for directing a flow of paint solvent at, around, and/or through the fabric of a paint roller. One such cleaning device is shown in U.S. Pat. No. 4,517,699. The cleaning device shown in U.S. Pat. No. 4,517,699 generally comprises an annular sleeve adapted to have an interference fit with a pad on a roller of a paint roller. This roller cleaning device includes liquid passage means within the annular sleeve with liquid outlet means communicating with the liquid passage means on the inner surface of the annular sleeve. The cleaning device shown in U.S. Pat. No. 4,517,699 requires that the annular sleeve have an interference fit with the pad on the paint roller in order to achieve effective cleaning of the paint roller. Thus, this known roller cleaning device will achieve maximum cleaning efficiency only for paint rollers having a particular diameter. The cleaning device shown in U.S. Pat. No. 4,517,699 will not provide efficient cleaning of paint rollers of varying diameters. In addition, in this known cleaning device, the cleaning solvent is applied to the outer surface of the roller through an annular slot disposed circumferentially about the inner surface of the annular sleeve of the cleaning device. Application of the cleaning solvent to the outer surface of the paint roller may cause paint on the roller to penetrate deeper into the fabric of the roller. In order to remove paint below the surface of the roller fabric, U.S. Pat. No. 4,517,699 provides a plurality of additional scrubber elements positioned circumferentially along the inner surface of the annular sleeve below the annular liquid outlet slot.

It is, therefore, an object of the present invention to provide a cleaning apparatus for paint rollers and the like which does not suffer from the disadvantages of prior cleaning devices.

It is further an object of the present invention to provide a cleaning apparatus which is adapted to effectively clean paint rollers of varying sizes.

It is still another object of the present invention to provide a cleaning device which directs cleaning solvent below the surface of the paint roller.

It is yet another object of the present invention to provide a cleaning device which can be readily connected to any of a number of types of cleaning fluids supplies.

Still another object of the present device is to provide a cleaning device which can be easily manufactured.

Additional objects and advantages of the present invention will be apparent to those skilled in the art by reference to the following detailed description and drawings wherein.

SUMMARY OF THE INVENTION

The present invention relates to a cleaning apparatus for cleaning a paint roller and the like. The cleaning apparatus comprises a handle having an axial passage therethrough and a curved cleaning head, adjacent one end of the handle, having an annular passage in fluid communication with the axial passage of the handle. A plurality of spaced, radially inwardly extending nipples are positioned circumferentially along the inner surface of the curved cleaning head. Each of the nipples has an end face provided with a fluid outlet and a fluid passage extending from the fluid outlet to the annular passage of the curved cleaning head. Means for attaching the cleaning apparatus to a cleaning fluid supply are provided at the other end of the handle.

DETAILED DESCRIPTION OF THE INVENTION

Figures 1, 2, 3:
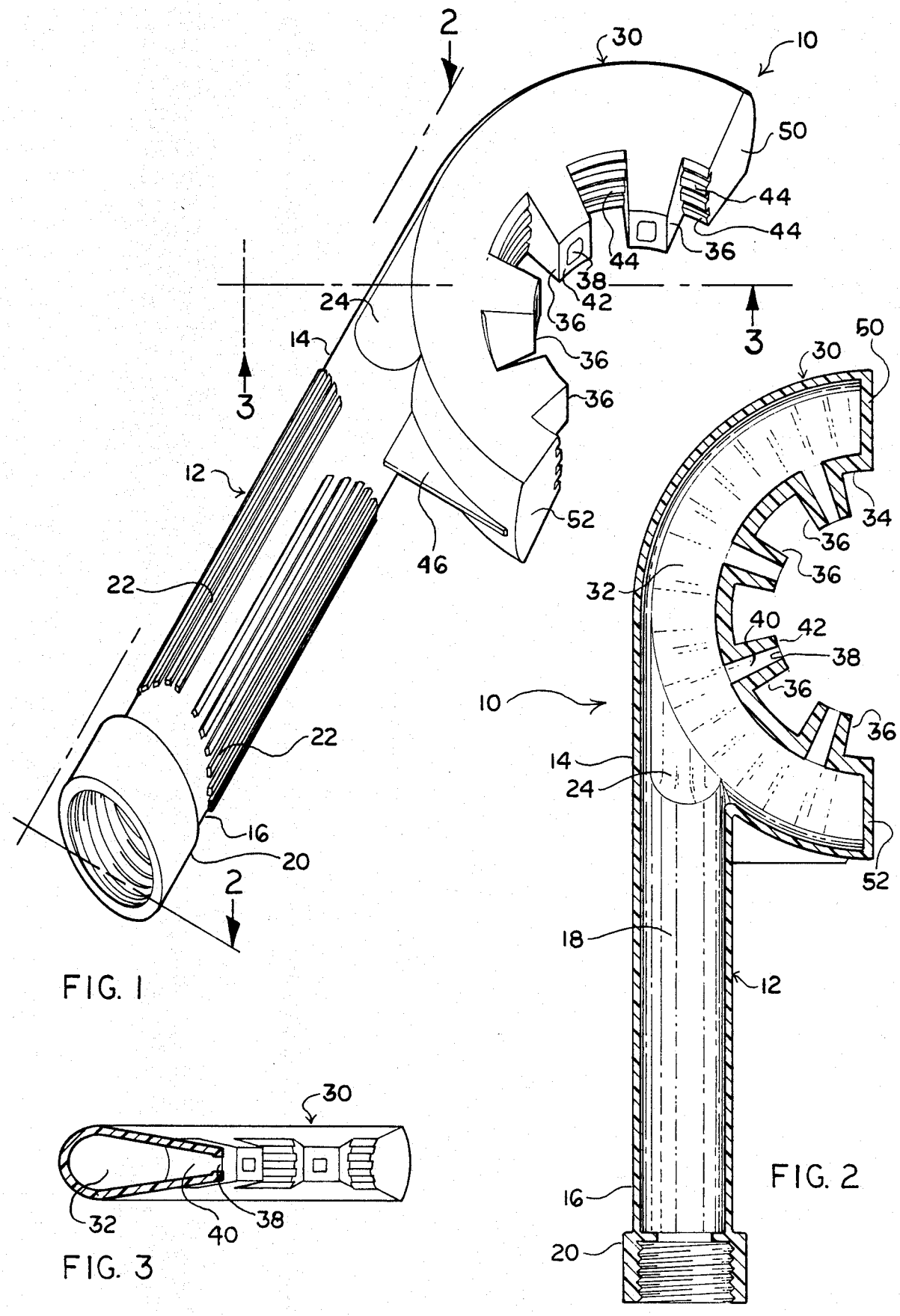
FIG. 1 is a perspective view of a cleaning apparatus of the present invention.
FIG. 2 is a cross-sectional view taken generally along Line 2—2 of FIG. 1.
FIG. 3 is a cross-sectional view taken generally along Line 3—3 of FIG. 1.

Referring now to FIGS. 1 and 2, there is shown a cleaning apparatus 10 of the present invention. Cleaning apparatus 10 preferably has a handle 12 and a curved cleaning head 30 adjacent a first end 14 of the handle 12. The handle 12 is preferably cylindrical and has an axial passage 18 extending from the first end 14 to a second end 16. The second end 16 of the handle 12 has means 20 for attaching the cleaning apparatus 10 to a cleaning fluid supply. Attaching means 20 can be any means capable of being connected to a cleaning fluid supply conduit. For example, the attaching means 20 can be a threaded neck as shown in FIGS. 1 and 2. In a preferred embodiment of the invention, the outer surface of the handle 12 is provided with a plurality of axial ribs 22 to facilitate gripping of the handle 12 by a person using the cleaning apparatus 10.

A curved cleaning head 30 is positioned adjacent the first end 14 of the handle 12. The cleaning head 30 has an annular passage 32 extending therethrough. If the curve of the cleaning head 30 is less than 360°, the annular passage 32 is closed at its ends by end walls 50,52. Preferably, the curve of cleaning head 30 is less than 360° and, most preferably, the cleaning head 30 is C-shaped.

In accordance with the scope of the present invention, it would be possible to omit the handle 12 and to provide the attaching means 20 directly on the cleaning head 30.

The annular passage 32 of the cleaning head 30 is in fluid communication with the axial passage 18 of the handle 12. It is preferred that the first end 14 of the handle 12 is necked down, as shown at 24, so that the cross-sectional area of the axial passage 18 at the first end 14 is smaller than the cross-sectional area of the axial passage 18 at the second end 16 of the handle 12. Due to this difference in the cross-sectional areas of the axial passage 18, cleaning fluid supplied to the cleaning apparatus 10 has a greater fluid pressure at the first end 14 of the axial passage 18 than at the second end 16. Thus, cleaning fluid enters the annular passage 32 at a higher pressure than the cleaning fluid is supplied to the cleaning apparatus 10 and the cleaning effectiveness of the cleaning apparatus 10 is enhanced.

A plurality of nipples 36 are positioned circumferentially along the inner suface 34 of the cleaning head 30. Nipples 36 are spaced apart and extend radially inwardly from the inner surface 34. As can best be seen in FIGS. 2 and 3, each of the nipples 36 has an end face 42 with a fluid outlet 38 provided therein. A fluid passage 40 extending from the fluid outlet 38 to the annular passage 32 of the cleaning head 30 is provided in each nipple 36. Fluid passages 40 are in fluid communication with annular passage 32 such that cleaning fluid from the annular passage 32 passes into the fluid passages 40 in the nipples 36 and exits the cleaning apparatus 10 through the fluid outlets 38. In a preferred embodiment of the cleaning apparatus 10, the cross-sectional area of the fluid outlets 38 is smaller than the cross-sectional area of the portion of the fluid passages 40 immediately adjacent the annular passage 32. This difference in cross-sectional areas causes the cleaning fluid to exit the cleaning head 30 through the fluid outlets 38 at a higher fluid pressure than that of the cleaning fluid entering the fluid passages 40 from the annular passage 32. This fluid pressure differential increases the cleaning efficiency of the cleaning apparatus 10.

The cleaning apparatus 10 may be made by any suitable means from a variety of materials. The cleaning apparatus 10 can, for example, be made using a plastic material which is easily molded. It will be apparent that various structural modifications may be made to the cleaning apparatus 10 without departing from the scope of the present invention. For example, reinforcing ribs 44 may be provided along the inner surface 34 of the cleaning head 30 between the nipples 36. A structural web, such as web 46, may also be provided to enhance the structural and/or aesthetic characteristics of the cleaning apparatus 10.

In operation, the cleaning apparatus 10 is attached to a cleaning fluid supply using attaching means 20 and a paint roller or the like which requires cleaning is brought into contact with the inner surface 34 of the cleaning head 30. When the paint roller is in contact with the cleaning head 30, nipples 36 extend below the surface of the roller fabric and cleaning fluid exiting from the cleaning apparatus 10 through the fluid outlets 38 initially contacts the paint roller beneath the outermost surface of the roller fabric.

Figure 4:
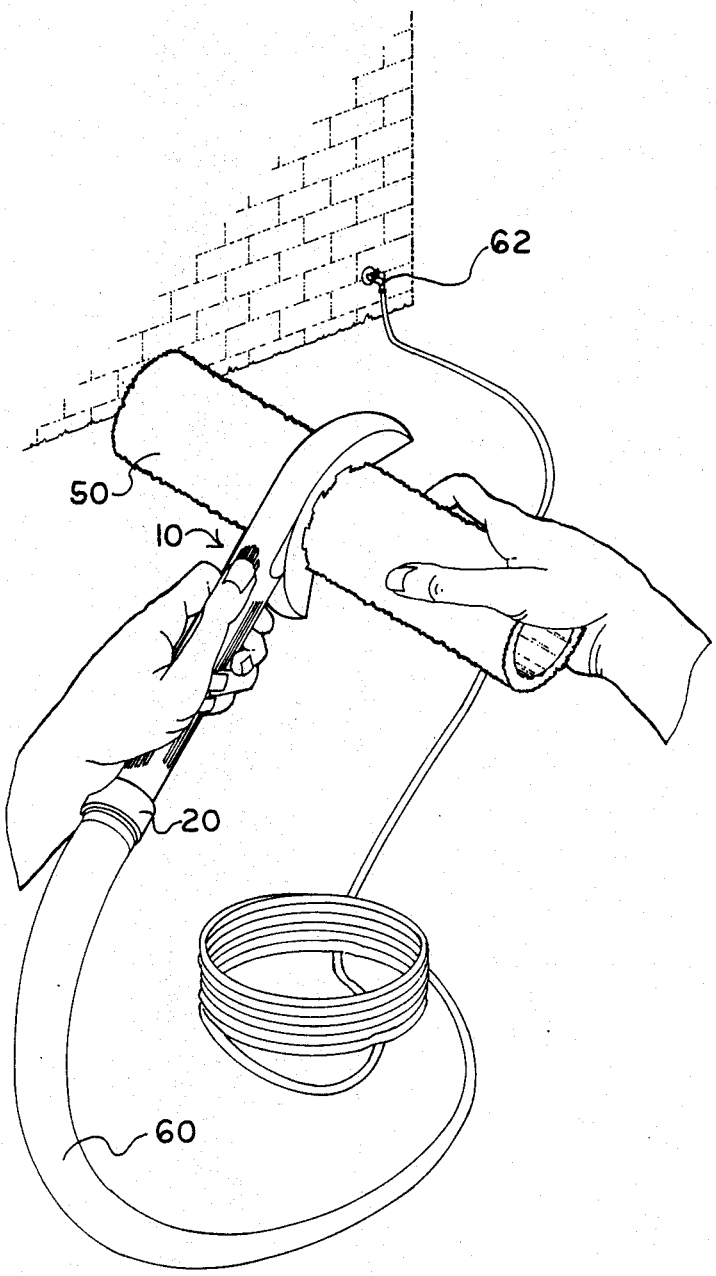
FIG. 4 is a perspective view of the embodiment shown in FIG. 1 in use on a garden hose.
Figure 5:
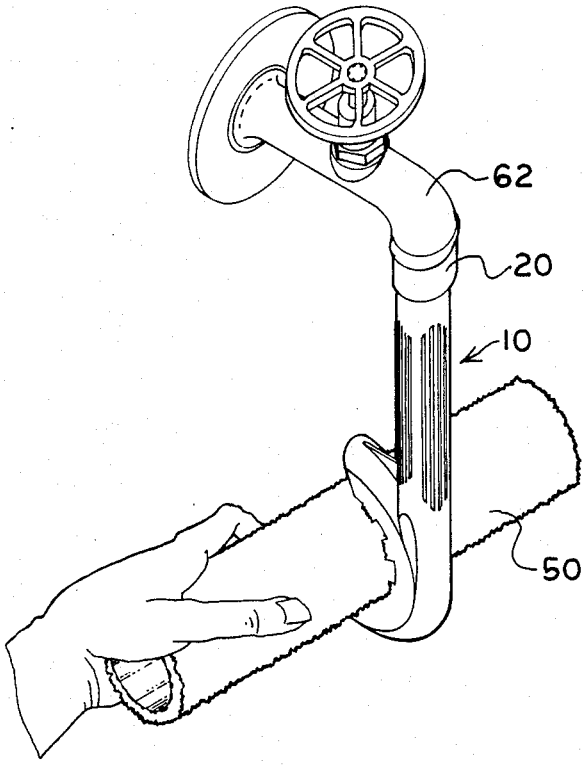
FIG. 5 is a perspective view of the embodiment shown in FIG. 1 in use on a faucet.

Two methods of using the cleaning apparatus 10 are shown in FIGS. 4 and 5. In FIG. 4, the cleaning apparatus 10 is attached to one end of a hose or conduit 60 and the other end of the hose 60 is attached to a cleaning fluid supply such as a water or solvent faucet 62. In FIG. 5, the cleaning apparatus 10 is attached directly to a cleaning fluid supply faucet 62. In use, the cleaning apparatus 10 is attached to the cleaning fluid supply through attaching means 20 and a paint roller 50 is brought into contact with the inner surface 34 of the cleaning head 30. Cleaning fluid from the cleaning fluid supply flows into axial passage 18 through the second end 16 of the handle 12. Within the cleaning apparatus 10, cleaning fluid flows through the axial passage 18 into the annular passage 32 and then into the fluid passages 40 in the nipples 36. Cleaning fluid exits from the fluid passages 40 through fluid outlets 38 and then contacts the paint roller 50. Cleaning of the paint roller 50 by the cleaning fluid is maximized by rotating and laterally moving the paint roller 50 and/or cleaning apparatus 10.

Cleaning apparatus 10 can be used with a variety of cleaning fluid supplies. An adapter or conduit of suitable construction may be interposed between attaching means 20 and a cleaning fluid supply if attaching means 20 is not compatible with a particular cleaning fluid supply outlet.

Although the invention has been described in detail with reference to a specific embodiment thereof, it will be understood that variations can be made without departing from the scope of the invention as described above and as claimed below.

What is claimed is:

1. Cleaning apparatus for cleaning a paint roller and the like, said cleaning apparatus comprising:

A. a C-shaped cleaning head having a curved inner surface and an annular passage therein;

B. a plurality of spaced, generally radially inwardly extending nipples positioned circumferentially along the inner surface of said cleaning head, each of said nipples having an end face provided with a fluid outlet and having a fluid passage extending from the fluid outlet to said annular passage of said cleaning head; and C. means for connecting said cleaning head to a cleaning fluid source to supply cleaning fluid to said annular passage and the fluid passages of said nipples, the curved inner surface of said cleaning head having a size and shape similar to that of the exterior of the roller to be cleaned, and said nipples being closely spaced and of sufficient length to penetrate the roller when it is brought into contact with said cleaning head, whereby cleaning fluid can be conveyed to the roller beneath the outer surface thereof through the fluid passages of said nipples.

2. The cleaning apparatus of claim 1 wherein said means for connecting said cleaning head to a cleaning fluid source is a handle having a generally axial passage therethrough in communication with said annular passage.

3. The cleaning apparatus of claim 2 wherein said handle is elongated and has one end thereof connected to said cleaning head, said handle having an opposite end that is constructed for connection to the cleaning fluid source.

4. The cleaning apparatus of claim 3 wherein the opposite end of said handle comprises a threaded neck.

5. The cleaning apparatus of claim 3 wherein the handle has an outer surface provided with a plurality of axially extending ribs.

6. The cleaning apparatus of claim 3 wherein the cross-sectional area of the axial passage at the one end of the handle is smaller than the cross-sectional area of the axial passage at the opposite end of the handle.

7. The cleaning apparatus of claim 1 wherein the inner surface of the curved cleaning head is further provided with a plurality of circumferential ribs between the nipples.

8. The cleaning apparatus of claim 1 wherein the cross-sectional area of the fluid outlet in each nipple is smaller than the cross-sectional area of a portion of the fluid passage in the nipple adjacent the annular passage.

9. Cleaning apparatus for cleaning a paint roller and the like, said cleaning apparatus comprising:

A. an elongated handle having an axial passage therethrough, said handle having a first end and a second end, wherein the cross-sectional area of the axial passage at the first end of the handle is smaller than the cross-sectional area of the axial passage at the second end of the handle;

B. a C-shaped cleaning head connected to said handle adjacent the first end thereof, said cleaning head having a curved inner surface and an annular passage in fluid communication with the axial passage of the handle;

C. a plurality of spaced, radially inwardly extending nipples positioned circumferentially along the inner surface of the cleaning head, each of said nipples having an end face provided with a fluid outlet and having a fluid passage extending from the fluid outlet to the annular passage of the cleaning head, wherein the cross-sectional area of the fluid outlet of each nipple is smaller than the cross-sectional area of the fluid passage in the nipple adjacent the annular passage of the cleaning head; and D. a neck adjacent the second end of the handle for attaching the cleaning apparatus to a cleaning fluid supply, the curved inner surface of said cleaning head having a size and shape similar to that of the exterior of the roller to be cleaned, and said nipples being closely spaced and of sufficient length to penetrate the roller when it is brought into contact with said cleaning head, whereby cleaning fluid can be conveyed to the roller beneath the outer surface thereof through the fluid passages of said nipples.

* * * * *